US008435136B2

(12) United States Patent
Stites et al.

(10) Patent No.: US 8,435,136 B2
(45) **Date of Patent: *May 7, 2013**

(54) GOLF CLUB HEAD HAVING A BRIDGE MEMBER AND A WEIGHT POSITIONING SYSTEM

(75) Inventors: John T. Stites, Weatherford, TX (US); Gary G. Tavares, Azle, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/294,240

(22) Filed: Nov. 11, 2011

(65) Prior Publication Data

US 2012/0058838 A1 Mar. 8, 2012

Related U.S. Application Data

(60) Division of application No. 12/727,900, filed on Mar. 19, 2010, now Pat. No. 8,066,584, which is a continuation of application No. 11/622,371, filed on Jan. 11, 2007, now Pat. No. 7,704,163, which is a division of application No. 10/707,599, filed on Dec. 23, 2003, now Pat. No. 7,201,669.

(51) Int. Cl.
*A63B 53/06* (2006.01)

(52) U.S. Cl.
USPC ..... 473/334; 473/350

(58) Field of Classification Search ..... 473/290–291, 473/334–339, 324, 350
See application file for complete search history.

(56) References Cited

U.S. PATENT DOCUMENTS

| | | | | |
|---|---|---|---|---|
| 1,133,129 | A | 3/1915 | Govan | |
| 2,155,830 | A * | 4/1939 | Howard | 473/246 |
| 2,932,515 | A * | 4/1960 | May | 473/248 |
| 3,655,188 | A | 4/1972 | Solheim | |
| 3,989,248 | A | 11/1976 | Campau | |
| D268,856 | S | 5/1983 | Fisher | |
| 4,398,965 | A | 8/1983 | Campau | |
| 4,736,951 | A * | 4/1988 | Grant | 473/246 |
| 4,826,172 | A | 5/1989 | Antonious | |
| 5,082,278 | A | 1/1992 | Hsien | |
| 5,209,473 | A | 5/1993 | Fisher | |
| 5,264,533 | A | 11/1993 | Rehmer | |
| 5,282,625 | A | 2/1994 | Schmidt | |
| 5,297,794 | A | 3/1994 | Lu | |

(Continued)

FOREIGN PATENT DOCUMENTS

| | | |
|---|---|---|
| GB | 232563 | 3/1925 |
| GB | 2316011 | 2/1998 |

(Continued)

OTHER PUBLICATIONS

"The Golf Club Identification and Price Guide III '50 to '93", the Golf Works, Jun. 1993, p. 19-7.

(Continued)

*Primary Examiner* — Stephen L. Blau
(74) *Attorney, Agent, or Firm* — Banner & Witcoff, Ltd.

(57) ABSTRACT

A golf club head is disclosed that includes a weight integral to a bridge member extending across a cavity back golf club head. The weight modifies a position of a center of gravity of the golf club head. The weight is independently movable in multiple directions to further vary the center of gravity of a golf club head.

20 Claims, 6 Drawing Sheets

U.S. PATENT DOCUMENTS

| | | | | |
|---|---|---|---|---|
| 5,297,803 | A | | 3/1994 | Solheim |
| 5,328,184 | A | | 7/1994 | Antonious |
| 5,330,187 | A | | 7/1994 | Schmidt |
| 5,333,872 | A | | 8/1994 | Manning |
| 5,385,348 | A | | 1/1995 | Wargo |
| 5,395,113 | A | | 3/1995 | Antonious |
| 5,401,021 | A | | 3/1995 | Allen |
| 5,472,203 | A | | 12/1995 | Schmidt |
| 5,484,146 | A | | 1/1996 | Loschiavo |
| D371,182 | S | | 6/1996 | Stities |
| 5,549,297 | A | | 8/1996 | Mahaffey |
| 5,584,770 | A | | 12/1996 | Jensen |
| 5,586,947 | A | | 12/1996 | Hutin |
| 5,658,208 | A | | 8/1997 | Shimasaki |
| 5,688,189 | A | * | 11/1997 | Bland ..... 473/314 |
| 5,738,596 | A | | 4/1998 | Meyer |
| 5,749,795 | A | | 5/1998 | Schmidt |
| 5,769,737 | A | | 6/1998 | Holladay |
| 5,833,551 | A | | 11/1998 | Vincent |
| 5,873,795 | A | | 2/1999 | Wozny |
| 5,899,817 | A | | 5/1999 | Dunikowski |
| 5,899,821 | A | | 5/1999 | Hsu |
| 5,916,042 | A | | 6/1999 | Reimers |
| 6,015,354 | A | | 1/2000 | Ahn |
| 6,030,295 | A | | 2/2000 | Takeda |
| 6,045,456 | A | | 4/2000 | Best |
| 6,077,173 | A | | 6/2000 | Stites |
| 6,080,069 | A | | 6/2000 | Long |
| 6,210,290 | B1 | | 4/2001 | Erickson |
| 6,277,032 | B1 | | 8/2001 | Smith |
| 6,280,348 | B1 | | 8/2001 | Stites |
| 6,290,607 | B1 | | 9/2001 | Gilbert |
| 6,315,678 | B1 | | 11/2001 | Teramoto |
| 6,406,382 | B1 | | 6/2002 | Deshmukh |
| 6,450,897 | B2 | | 9/2002 | Stites |
| 6,592,469 | B2 | | 7/2003 | Gilbert |
| 6,692,371 | B2 | | 2/2004 | Berish |
| D488,203 | S | | 4/2004 | Madore |
| 6,923,732 | B2 | | 8/2005 | Stites |
| 6,991,559 | B2 | | 1/2006 | Yabu |
| 7,300,361 | B2 | | 11/2007 | Stites |
| 7,476,162 | B2 | | 1/2009 | Stites |
| 2001/0014628 | A1 | | 8/2001 | Erickson |
| 2001/0055996 | A1 | | 12/2001 | Iwata |
| 2003/0092502 | A1 | | 5/2003 | Pergande |
| 2003/0119601 | A1 | | 6/2003 | Nelson |
| 2003/0199331 | A1 | | 10/2003 | Stites, III |
| 2003/0203764 | A1 | | 10/2003 | Dabbs |
| 2003/0228928 | A1 | | 12/2003 | Yabu |
| 2004/0176177 | A1 | | 9/2004 | Mahaffey |
| 2005/0037864 | A1 | | 2/2005 | Gilbert |
| 2005/0239572 | A1 | | 10/2005 | Roach |
| 2008/0070722 | A1 | | 3/2008 | Stites |

FOREIGN PATENT DOCUMENTS

| | | |
|---|---|---|
| GB | 2365785 | 2/2002 |
| JP | 9135933 | 5/1997 |
| JP | 9239077 | 9/1997 |
| JP | 09285576 | 11/1997 |
| JP | 10005377 | 1/1998 |
| JP | 10155948 | 6/1998 |
| JP | 11047322 | 2/1999 |
| JP | 11070192 | 3/1999 |
| JP | 11070194 | 3/1999 |
| JP | 2000005356 | 1/2000 |
| JP | 2000005357 | 1/2000 |
| JP | 2000210400 | 2/2000 |
| JP | 2000093566 | 4/2000 |
| JP | 2000334073 | 12/2000 |
| JP | 2000345204 | 12/2000 |
| JP | 2001009070 | 1/2001 |
| JP | 2001079124 | 3/2001 |
| JP | 2001161870 | 6/2001 |
| JP | 2001190720 | 7/2001 |
| JP | 2001204863 | 7/2001 |
| JP | 2001314535 | 11/2001 |
| JP | 2001046560 | 2/2002 |
| JP | 2001087430 | 3/2002 |
| JP | 2002143355 | 5/2002 |
| JP | 2002186696 | 7/2002 |
| JP | 2002191729 | 7/2002 |
| JP | 2002253710 | 9/2002 |
| JP | 2003062132 | 3/2003 |
| WO | 9315151 | 8/1993 |
| WO | 0010653 | 3/2000 |

OTHER PUBLICATIONS

"The Golf Club Identification and Price Guide IV 1950 to 1998", GolfWorks Maltby, Nov. 1985, pp. 20-7 and 20-10.

Ben Hogan Irons, Apex Edge Pro CFT Iron, http://www.benhogan.com/products_irons_edgeCFT.html Nov. 20, 2003, 2 pages.

Ben Hogan—Custom Options, http://www.benhogan.com/custom.html, Nov. 20, 2003, 3 pages.

International Search Report for PCT/US2004/042833 mailed May 10, 2005.

Revised Edition, 1975, The Random House College Dictionary (3 pages), title page, copyright page, p. 168, Definition of "bridge".

Ben Hogan Golf 2004, Edge CFT Hybrids "h" Iron Set, Same Edge CFT Technology . . . Improved by Including Two CFT Hybrids, copyright Callaway Golf Company, 2004, 4 pages.

International Search Report and Written Opinion for PCT/US2005/027630 mailed Feb. 15, 2006.

International Search Report for PCT/IB03/05942, dated Jun. 30, 2004, 5 pages.

Office Action for U.S. Appl. No. 12/474,691 mailed Apr. 5, 2010.

Written Opinion and International Search Report for Application No. PCT/US2010/033492 mailed Sep. 15, 2010, 11 pages.

* cited by examiner

GOLF CLUB HEAD HAVING A BRIDGE MEMBER AND A WEIGHT POSITIONING SYSTEM

This application is a divisional of U.S. application Ser. No. 12/727,900 filed Mar. 19, 2010, which is a continuation of U.S. application Ser. No. 11/622,371 filed Jan. 11, 2007, now U.S. Pat. No. 7,704,163, issued Apr. 27, 2010, which is a divisional of U.S. application Ser. No. 10/707,599 filed Dec. 23, 2003, now U.S. Pat. No. 7,201,669 issued Apr. 10, 2007, all of which are incorporated herein by reference.

BACKGROUND OF INVENTION

The present invention relates to golf club heads. More particularly, the invention concerns a golf club head having a bridge member and a weight positioning system for modifying a position of a center of gravity of the golf club head.

DESCRIPTION OF THE INVENTION

A golf club head generally includes a substantially planar contact area for engaging a golf ball and propelling the golf ball in an intended direction. One factor that determines whether the golf ball is propelled in the intended direction relates to a position of a center of gravity of the golf club head. When the center of gravity is positioned behind the point of engagement on the contact surface, the golf ball follows a generally straight route. When the center of gravity is positioned to a side of the point of engagement, however, the golf ball may follow a route that curves left or right, which is often referred to as a hook or a slice. Similarly, when the center of gravity is positioned above or below the point of engagement, the route of the golf ball may exhibit a boring or climbing trajectory.

Most conventional golf club heads have a fixed center of gravity, which does not allow golfers to make adjustments to the center of gravity of a golf club head. However, a golfer may wish to make adjustments to the center of gravity of a particular golf club head in order to help square the golf club head face at impact with a golf ball. For example, a golfer may tend to misdirect the golf shot by hooking or slicing a golf shot. With this in mind, a number of systems have been developed to modify the weight distribution of a golf club head to help square the golf club head at impact with a golf ball. However, there still exists a need in the art for a simplified golf club head and weight positioning system that modifies a golf club head's center of gravity.

SUMMARY OF THE INVENTION

The above-mentioned need in the prior art is satisfied by the golf club head of the present invention. The golf club head of the present invention may include a bridge member having a weight positioning system where the center of gravity is adjustable and is located between the bridge member and the back of the striking face of the golf club head.

In an embodiment of the invention, a golf club head comprises a heel, a toe, and a body that extends between the toe and the heel. The golf club head body comprises a striking face, a rear cavity and a bridge member including a weight. The striking face provides a contact area for engaging a golf ball. The bridge member extends across the rear cavity. The weight varies the position of a center of gravity of the golf club head with respect to the striking face.

In another embodiment of the invention, a golf club head comprises a heel, a toe, and a striking face that provides a contact area for engaging a golf ball. The golf club head also includes a rear cavity opposite the striking face and a bridge member that extends across the rear cavity. The golf club head further includes a weight positioning assembly integral to the bridge member. The weight positioning assembly includes a rail, and a weight movably-connected to the rail. The weight is movable along the rail to vary the position of a center of gravity of the golf club head in a first direction with respect to the striking face. The weight is also rotatable to further vary the position of the center of gravity of the golf club head in a second direction with respect to the striking face.

In a further embodiment of the invention, a golf club includes a shaft and a head positioned on an end of the shaft. The golf club head includes a striking face that provides a contact area for engaging a golf ball and a rear cavity opposite the striking face. The golf club head further includes a bridge member extending across the rear cavity and a weight positioning system integral to the bridge member. The weight positioning system comprises a weight, which is movable in three dimensions with respect to the striking face to vary a position of a center of gravity of the golf club head with respect to the striking face.

In yet another embodiment of the invention, a set of iron golf clubs includes a plurality of increasing numbered iron golf clubs. Each of the numbered iron golf clubs includes a shaft and a golf club head positioned on the end of a shaft. The golf club heads include a striking face that provides a contact area for engaging a golf ball and a rear cavity opposite the striking face. Each golf club head further includes a bridge member extending across the rear cavity and a weight attached to the bridge member to vary a position of a center of gravity of the golf club head with respect to the striking face.

In yet a further embodiment of the invention, a golf club head comprises a striking face that provides a contact area for engaging a golf ball and a rear cavity opposite the striking face. The golf club head further includes a bridge member extending across the rear cavity and a weight positioning assembly integral to the bridge member. The weight positioning assembly includes a rail, and a plurality of weights movably-connected to the rail. The weights are movable along the rail to vary the position of a center of gravity of the golf club head in a first direction with respect to the striking face. The weights are also rotatable to further vary the position of the center of gravity of the golf club head in a second direction with respect to the striking face.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

BRIEF DESCRIPTION OF THE DRAWINGS

The present invention is illustrated by way of example and not limited in the accompanying figures in which like reference numerals indicate similar elements and in which.

DETAILED DESCRIPTION

The following discussion and accompanying figures disclose various iron golf clubs in accordance with the present invention. Each golf club includes a golf club head with a weight positioning system for varying a position of a center of gravity of the golf club head.

Figure 1:
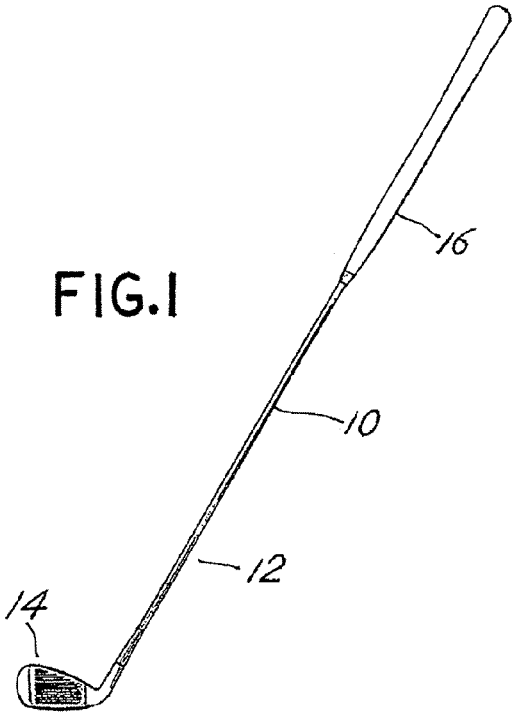
FIG. 1 illustrates an elevational view of a golf club having a golf club head in accordance with the present invention.

Referring to FIG. 1, golf club 10 includes a shaft 12 and a golf club head 14. The golf club head 14 of FIG. 1 may be representative of an iron golf club head of the present invention. The shaft 12 of golf club 10 may be made of various materials such as steel, titanium, graphite, or a composite material. A grip 16 is positioned on the shaft 12 to provide a golfer with a slip resistant surface on which to grasp golf club 10.

Figure 2:
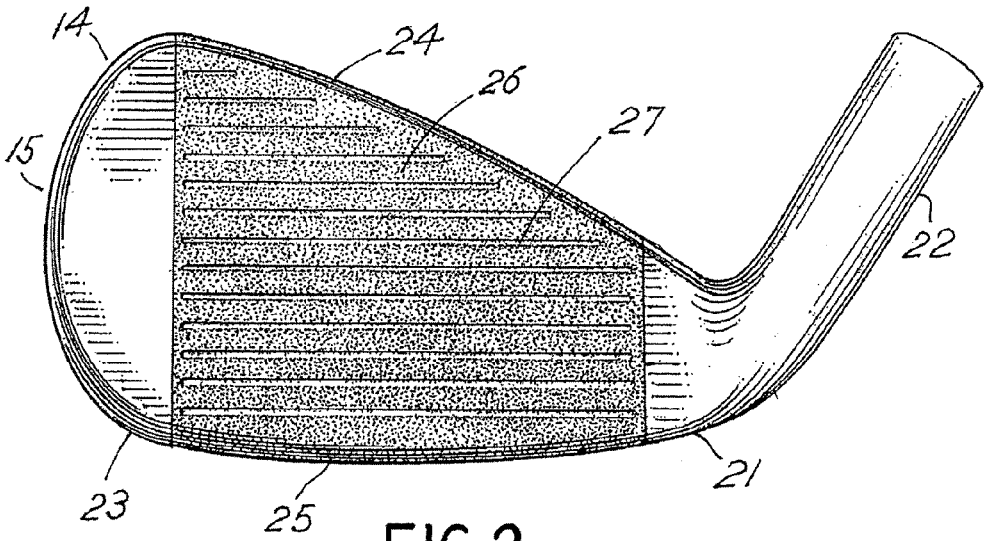
FIG. 2 illustrates a front view of a golf club head in accordance with the present invention.

As shown in FIG. 2, the golf club head 14 comprises a body 15 that includes a heel 21 and toe 23, the body 15 extending between the heel 21 and the toe 23. The heel 21 is attached to a hosel 22 for connecting the shaft 12 of FIG. 1 to the golf club head 14. The body 15 also includes a top portion 24 and a sole portion 25. A striking face 26 extends between the top portion 24 and the sole portion 25, and between the toe 23 and the heel 21. The striking face 26 provides a contact area for engaging and propelling a golf ball in an intended direction. The striking face 26 comprises horizontal grooves 27 for the removal of water and grass from the striking face 26. The body 15 of golf club head 14 may be constructed of various materials such as steel, titanium, aluminum, tungsten, graphite, polymers, plastics or composites.

Figure 3:
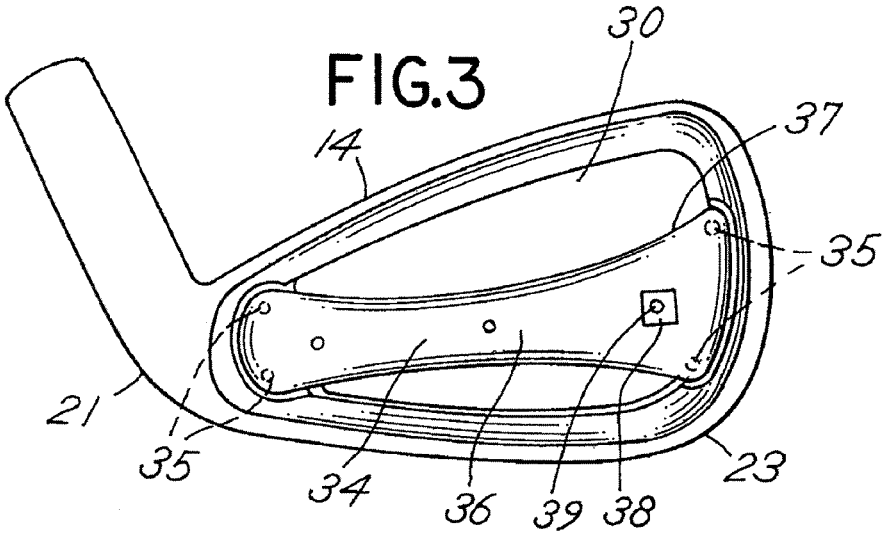
FIG. 3 illustrates a rear view of a golf club head with a weight chip attached to the bridge member in accordance with the present invention.

FIG. 3 illustrates a rear view of a golf club head 14. Golf club head 14 of the present invention includes a rear cavity 30 positioned opposite the striking face 26 (FIG. 2). A bridge member 34 having a front surface 36 and a back surface 37 extends across the rear cavity 30 which may connect the heel 21 to the toe 23. Bridge member 34 may also be extended across the rear cavity 30 and connected to various other locations on the golf club head 14 as shown, for example, in U.S. Pat. No. 6,450,897 issued on Sep. 17, 2002, which is hereby incorporated by reference in its entirety. Bridge member 34 may be made of various shapes such as rectangle, oval, triangle, trapezoid, square or other symmetrical or asymmetrical shapes. Bridge member 34 may also have a non-uniform width or thickness throughout its length.

Bridge member 34 may be formed with the golf club head 14 in a single casting making the bridge member 34 integral with the golf club head 14. As an alternative, bridge member 34 may be connected to the toe 23 and heel 21 using set screws 35. Those skilled in the art will realize that bridge member 34 may be connected to the toe 23 and heel 21 using fewer or additional connection points and through numerous other connection means which fall within the scope of the present invention.

Figure 4:
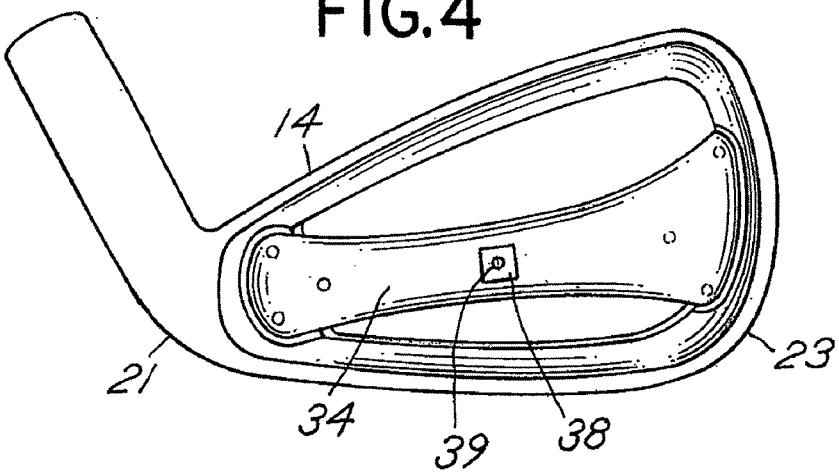
FIG. 4 illustrates another rear view of a golf club head with a weight chip attached to the bridge member in a different position in accordance with the present invention.
Figure 5:
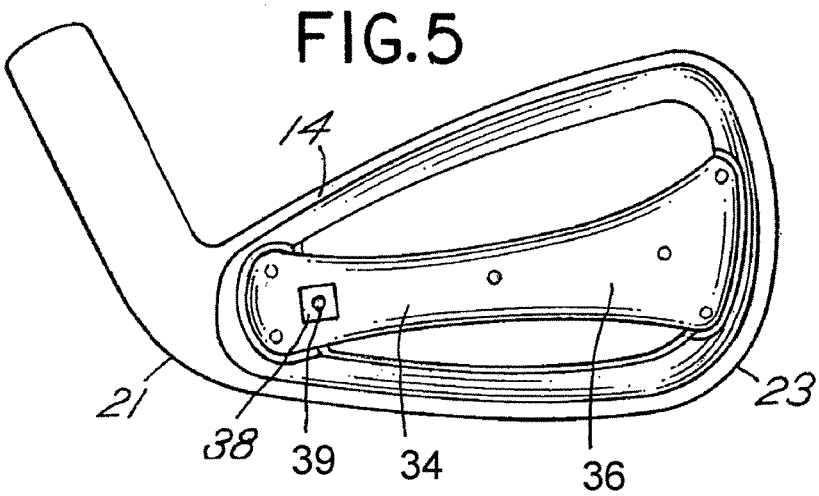
FIG. 5 illustrates an additional rear view of a golf club head with a weight chip attached to the bridge member in another position in accordance with the present invention.

Bridge member 34 may have a weight 38 attached to the front surface 36 of bridge member 34 at various fixed locations and shown in FIGS. 3 through 5. For example, in FIG. 3 weight 38 may be attached to the front surface 36 of bridge member 34 closer to toe 23 of golf club head 14. As an alternative, weight 38 may be attached to front surface 36 in the center of bridge member 38 (FIG. 4) or closer to the heel 21 of golf club head 14 (FIG. 5). Furthermore, weight 38 may be attached to various locations on the back surface 37 of bridge member 34.

Those skilled in the art will realize that weight 38 may be made of various shapes such as rectangle, oval, triangle, trapezoid, square or other symmetrical or asymmetrical shapes. For example, in FIGS. 3-5, weight 38 may be referred to as a rectangular weight chip. Weight 38 may also be made of various materials such as stainless steel, carbon steel, titanium, aluminum, tungsten, graphite, polymers, plastics or composites. In addition, weight 38 may be interchangeable with a plurality of alternative weights having different shapes and masses as compared to weight 38.

Weight 38 may be connected to the front surface 36 or back surface 37 of bridge member 34 using a locking pin 39. Those skilled in the art will realize that weight 38 may be attached and locked into position onto bridge member 34 utilizing other connection hardware such as a locking screw and still remain within the scope of the present invention. Those skilled in the art will also realize that more than one weight 38 may be attached to bridge member 34.

During the game of golf, an individual holds grip 16 and swings golf club 10 such that golf club head 14 traverses a generally arcuate path and impacts a golf ball. A portion of the inertia of golf club 10, and particularly the inertia of golf club head 14, is then transferred to the golf ball and propels the golf ball toward an intended target. The position of a center of gravity of head 14 has an influence upon whether the golf ball curves right, curves left, or follows a generally straight route.

More specifically, the golf ball follows a generally straight route when the center of gravity is positioned behind the point of engagement on striking face 26. When the center of gravity is positioned to one side of the point of engagement, however, the golf ball may follow a route that curves left or right. The position of the center of gravity of golf club head 14 also has an influence upon whether the golf ball exhibits a boring or climbing trajectory, depending upon whether the center of gravity is positioned above or below the point of engagement on striking face 26.

Although the concepts behind utilizing a golf club to propel a golf ball toward an intended target appear simplistic, the actual practice of propelling the golf ball in an intended manner is exceedingly complex. The golf ball may, for example, consistently curve right when, in fact, the individual intends to propel the golf ball along a straight route. Many conventional golf club heads have a center of gravity located at the striking face 26. However, changing the position of the center of gravity of the golf club head 14 for different golf clubs may assist many golfers in squaring the club head face 14 upon impact with a golf ball. The positioning of the center of gravity off of the striking face 26 and towards the rear of the golf club head 14 may conform to the style and preferences of many golfers. Accordingly, these golfers may be able to correct or modify the route of the golf ball by using the golf club head 14 of the present invention as the center of gravity of golf club head 14 is repositioned with respect to striking face 26 as compared to other golf club heads.

The center of gravity of golf club head 14, otherwise referred to as the center of mass, is defined as an equilibrium point. More specifically, the center of gravity of golf club head 14 is a point at which the entire weight of golf club head 14 may be considered as concentrated so that, if supported at that point, head 14 would remain in static equilibrium in any position. The center of gravity of golf club head 14 may be changed by altering the weight distribution of the golf club head 14 away from the striking face 26. Altering the weight distribution of golf club head 14 may be accomplished with the use of bridge member 34 and weight 38 of the present invention.

Bridge member 34 and weight 38 increase the weight of the back of the golf club head 14 relative to the striking face 26 of the golf club head 14. This increase in weight towards the rear of golf club head 14 alters the center of gravity of golf club head 14. By moving the center of gravity lower and towards the rear of the golf club head 14, a golf shot will tend to have an increased loft upon impact. By moving the center of gravity higher and towards the rear of the golf club head 14, a golf shot will tend to have a decreased loft upon impact.

In addition, the shape and location of bridge member 34 and weight 38 may also influence the location of the center of gravity of golf club head 14. For example, on the longer iron clubs, two iron through five iron, it is desirable to have the center of gravity lower than on the shorter iron clubs. On the longer iron clubs, a lower center of gravity will assist a golfer with obtaining additional loft on their golf shot. Therefore, the bridge member 34 for longer iron clubs may be positioned lower on the rear of the golf club head body 14 as compared to a bridge member 34 on shorter iron clubs.

Moving the center of gravity of golf club head 14 may be accomplished through the use of weight 38. Weight 38 increases the weight of the back of the golf club head 14 relative to the striking face 26. The increase in weight to the back of golf club head 14 relative to the striking face 26 alters the center of gravity of golf club head 14.

Figure 6:
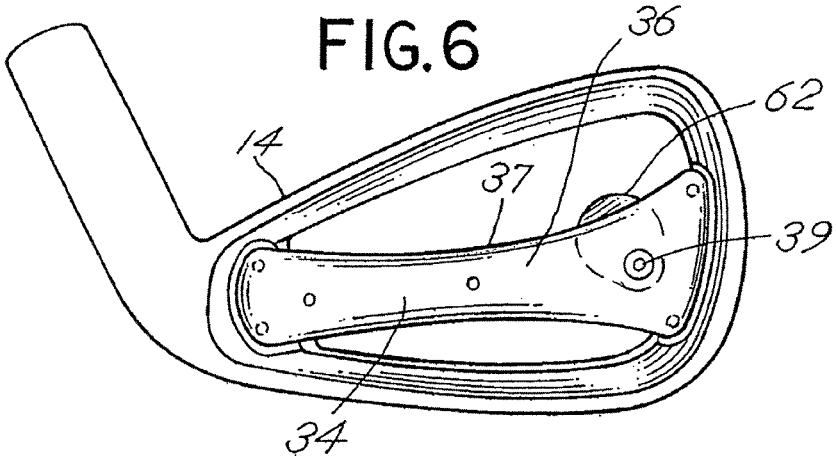
FIG. 6 illustrates a rear view of a golf club head with an elliptical shaped weight attached to the bridge member in accordance with the present invention.

With reference to FIGS. 3-5, weight 38 may be moved to adjust the center of gravity of club head 14. By moving weight 38 to different locations as shown in FIGS. 3 5, the position of the center of gravity of a golf club head with respect to the striking face is varied. In particular, moving the center of gravity of golf club head 14 relative to the striking face 26 may help the golfer drive a golf ball to the left or right of the fairway. For example, FIG. 3 shows weight 38 towards the toe 23 of golf club head 14. The location of weight 38 towards the toe 23 will tend to drive a golf ball towards the right of a fairway. In FIG. 5, the weight 38 is towards the heel 21 of the golf club head 14. The weight 38 as depicted in FIG. 5 will tend to drive a golf ball toward the left of the fairway. In FIG. 6, the weight 38 is attached to front surface 36 near the center of bridge member 34 and will tend to produce a balanced shot directing the golf ball along a straight route towards the middle of the fairway.

Figure 7:
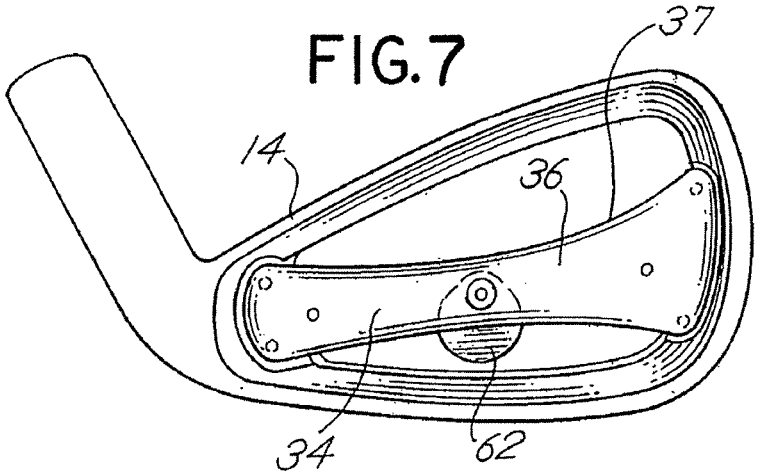
FIG. 7 illustrates another rear view of a golf club head with an elliptical shaped weight attached to the bridge member in a different position in accordance with the present invention.
Figure 8:
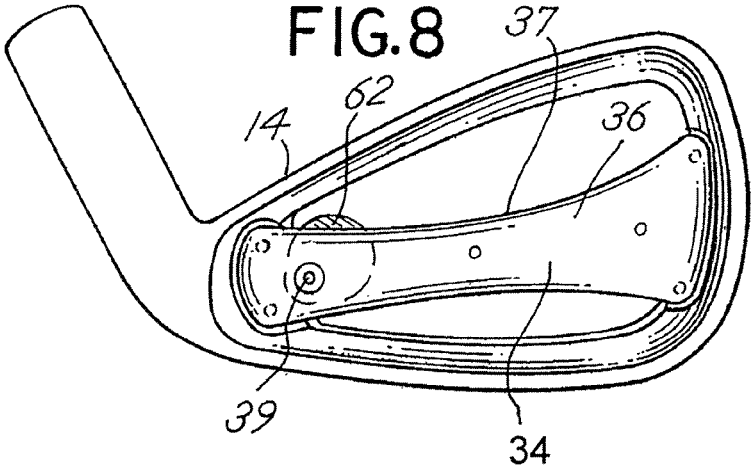
FIG. 8 illustrates an additional rear view of a golf club head with an elliptical shaped weight attached to the bridge member in another position in accordance with the present invention.

With reference to FIGS. 6-8, in an alternative embodiment a weight 62 may comprise an elliptical shape. An elliptical shaped weight 62 may be located in various fixed positions on bridge member 34. The elliptical shaped weight 62 may be rotated to vary the position of the center of gravity of golf club head 14 in a second direction with respect to the striking face 26 (FIG. 2). As discussed above, the position of the center of gravity of golf club head 14 influences whether a golf shot exhibits an arcing or a low, flat trajectory, depending upon where the center of gravity is located. Accordingly, rotating and positioning the elliptical shaped weight 62 above the point of engagement raises the center of gravity of golf club head 14. The raising of the center of gravity of golf club head 14 allows a golfer to propel a golf ball with a lower and more controlled trajectory. Additionally, rotating and positioning elliptical shaped weight 62 below the point of engagement lowers the center of gravity of golf club head 14. The lowering of the center of gravity of golf club head 14 allows a golfer to propel a golf ball with additional loft.

Elliptical shaped weight 62 may be connected to the front surface 36 or back surface 37 of bridge member 34 using a locking pin 39. Those skilled in the art will realize that the elliptical shaped weight 62 may also be attached and locked into position on bridge member 34 utilizing other connection hardware such as a locking screw and still remain within the scope of the present invention.

Figure 9:
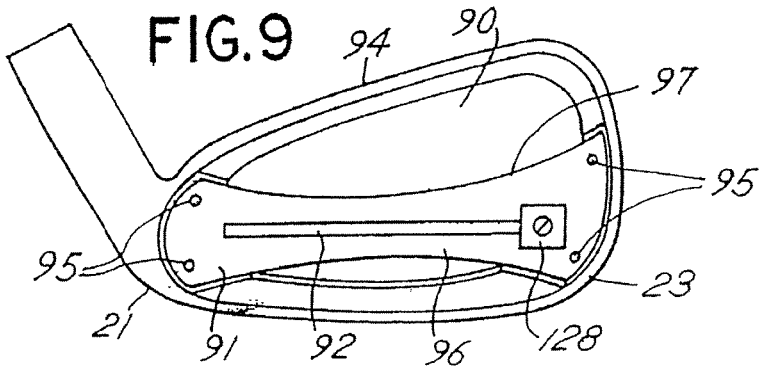
FIG. 9 illustrates a rear view of a golf club head with a rail and weight assembly integral to a bridge member in accordance with the present invention.
Figure 10:
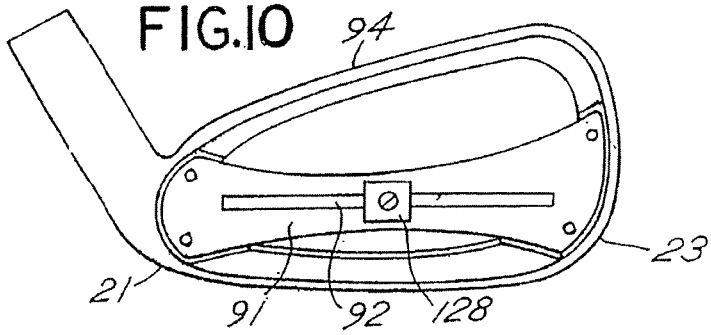
FIG. 10 illustrates another rear view of a golf club head with a rail and weight assembly integral to a bridge member in accordance with the present invention.
Figure 11:
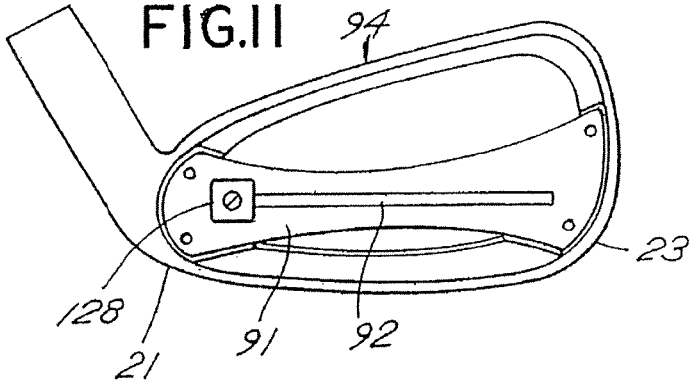
FIG. 11 illustrates an additional rear view of a golf club head with a rail and weight assembly integral to a bridge member in accordance with the present invention.

FIGS. 9-12 illustrate another embodiment of the present invention. In this embodiment, the elevational view of FIG. 1 and front view of FIG. 2 are similar and will not be repeated below. In FIGS. 9-11, a golf club head 94 includes a rear cavity 90 positioned opposite to striking face 26 (FIG. 2). A bridge member 91 having a front surface 96 and a back surface 97 extends across the rear cavity 90 which may connect the heel 21 to the toe 23. Bridge member 91 may also extend across the rear cavity 90 and connect to various other locations on golf club head 94 as shown, for example, in U.S. Pat. No. 6,450,897 issued on Sep. 17, 2002, which has already been incorporated by reference in its entirety. Bridge member 91 may be made of various shapes such as rectangle, oval, triangle, trapezoid, square or other symmetrical or asymmetrical shapes. Bridge member 91 may also have a non-uniform width or thickness throughout its length.

Bridge member 91 may be formed with the golf club head 94 in a single casting making the bridge member 91 integral with the golf club head 14. As an alternative, bridge member 91 may be connected to the toe 23 and heel 21 using set screws 95. Those skilled in the art will realize that bridge member 91 may be connected to the toe 23 and the heel 21 using fewer or additional connection points and through numerous other connection means which fall within the scope of the present invention.

Figure 12:
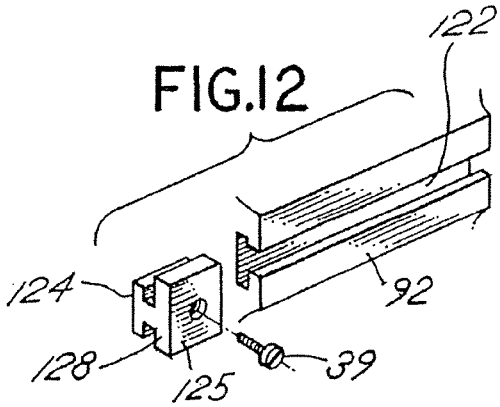
FIG. 12 illustrates a rail and weight assembly in accordance with the present invention.

Bridge member 91 may have a rail 92 formed in the front surface 96 of bridge member 91. An embodiment of rail 92 is illustrated in FIG. 12 where rail 92 may comprise a channel 122 for engaging a first surface 124 of a weight 128. A second surface 125 of weight 128 may slide along the outside of rail 92 allowing a golfer to lock into place weight 128 with a set screw 39. A golfer utilizing the golf club head 94 of FIGS. 9 12 may position the weight 128 in various locations along rail 92. For example, in FIG. 9 weight 128 may be located on rail 92 in a location close to the toe 23 of golf club head 94. As an alternative, weight 128 of FIG. 10 may be located near the center of bridge member 91 or closer to the heel 21 of golf club head 94 (FIG. 11). By moving weight 128 along rail 92 a golfer can selectively modify the position of the center of gravity of head 94 in a first direction with respect to the striking face. By modifying the center of gravity of golf club head 94, the golfer can adjust the club head 94 to conform to the particular playing style and preferences of the golfer. Accordingly, the golfer may modify the route of the golf ball by repositioning the center of gravity of head 94 with respect to striking face 26 (FIG. 2).

Figure 13:
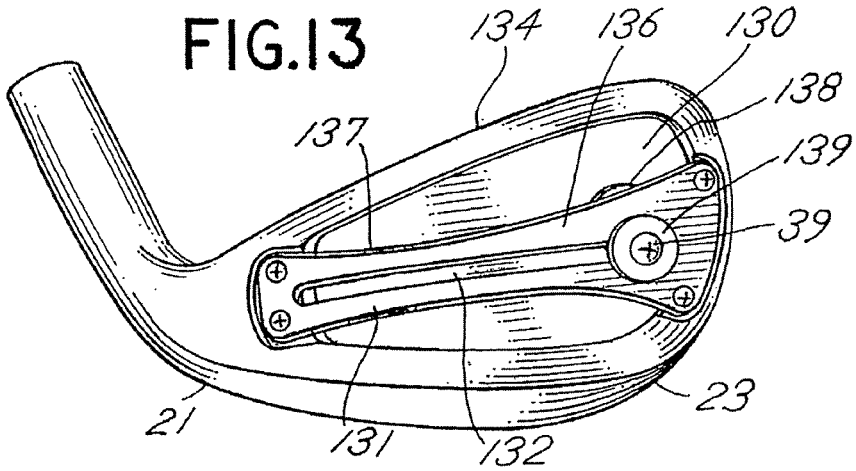
FIG. 13 illustrates a rear view of a golf club head with a rail integral to a bridge member and an elliptical shaped weight attached to the rail in accordance with the present invention.
Figure 14:
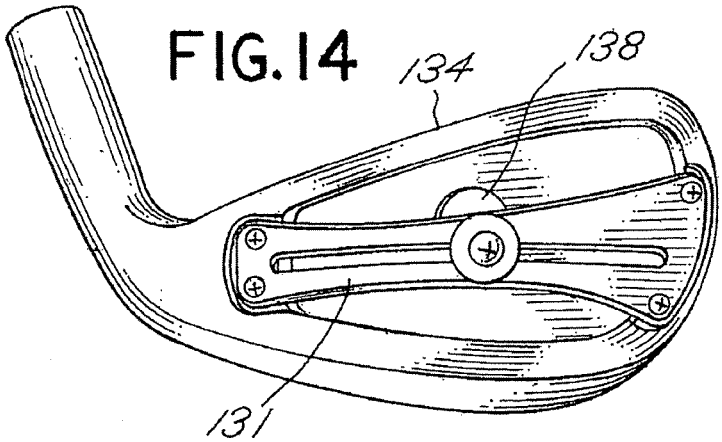
FIG. 14 illustrates another rear view of a golf club head with a rail integral to a bridge member and an elliptical shaped weight in a different position in accordance with the present invention.
Figure 15:
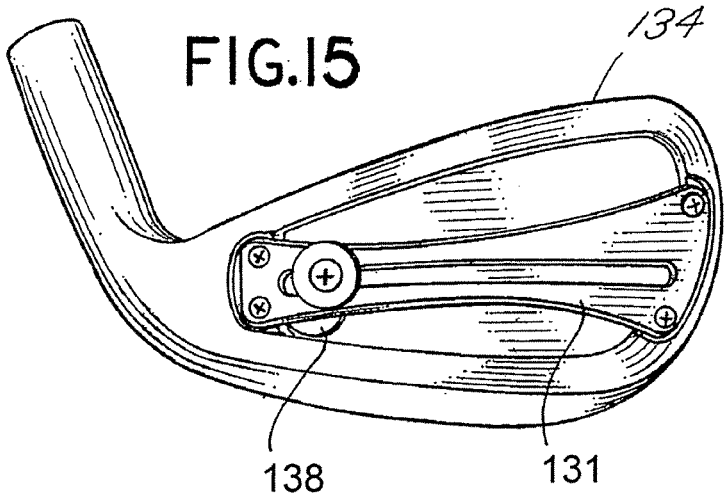
FIG. 15 illustrates an additional rear view of a golf club head with a rail integral to a bridge member and an elliptical shaped weight in another alternative position in accordance with the present invention.

FIGS. 13 through 15 illustrate another embodiment of the present invention. In FIG. 13, a golf club head 134 comprises a heel 21, a toe 23, and a striking face 26 (FIG. 2) that provides a contact area for engaging a golf ball. The golf club head 134 also includes a rear cavity 130 opposite the striking face 26 (FIG. 2) and a bridge member 131 that extends across rear cavity 130. The golf club head 134 further includes a weight positioning assembly integral to bridge member 131. The weight positioning assembly includes a rail 132 and a weight 138 movably connected to the rail 132. The rail 132 may extend from the front surface 136 of bridge member 131 through to the back surface 137. The weight 138 is movable along rail 132 to vary a position of a center of gravity of the golf club head 134 in a first direction with respect to the striking face 26 (FIG. 2). The weight 138 may also be rotated to further vary the position of the center of gravity of golf club head 134 in a second direction with respect to striking face 26 (FIG. 2).

Weight 138 as illustrated in FIGS. 13-15 may comprise an elliptical shape. The elliptical shaped weight 138 may be located in various positions on bridge member 131. Elliptical shaped weight 138 may be connected to the front surface 136 or back surface 137 of bridge member 131 using a washer 139 and a set screw 39. Those skilled in the art will realize that the elliptical shaped weight 138 may also be attached and positioned on bridge member 131 utilizing other connection hardware such as a locking pin and still remain within the scope of the present invention.

The position of the center of gravity of golf club head 134 influences whether a golf shot exhibits an arcing or a low, flat trajectory, depending upon where the center of gravity is located. Accordingly, rotating and positioning elliptical shaped weight 138 above the point of engagement raises the center of gravity of golf club head 134. The raising of the center of gravity of golf club head 134 allows a golfer to propel a golf ball with a lower and more controlled trajectory. Additionally, rotating and positioning elliptical shaped weight 138 below the point of engagement lowers the center of gravity of golf club head 134. The lowering of the center of gravity of golf club head 134 allows a golfer to propel a golf ball with additional loft. By moving and rotating elliptical shaped weight 138 in three dimensions, a golfer has great flexibility to position of the center of gravity of head 134 with respect to the striking face 26 (FIG. 2) as needed.

For example, in FIG. 13 elliptical shaped weight 138 is located on bridge member 131 near the toe 23 of golf club head 134. In addition, elliptical shaped weight 138 is also rotated into a position above the point of engagement of a golf ball as indicated by its elevated position, above bridge member 131 in FIG. 13. This placement of elliptical shaped weight 138 as shown in FIG. 13 will tend to raise and shift the center of gravity of golf club head 134 towards the toe 23 of golf club head 134. A golf ball hit with this particular golf club head configuration will tend to propel a golf ball with a lower and more controlled trajectory towards the right of the fairway.

As another example, FIG. 14 shows elliptical shaped weight 138 located near the center of bridge member 131 of golf club head 134. In addition, elliptical shaped weight 138 is also rotated into a position above the point of engagement of a golf ball as indicated by its elevated position, above bridge member 131 in FIG. 14. This placement of elliptical shaped weight 138 as shown in FIG. 14 will tend to raise the center of gravity of golf club head 134. A golf ball hit with this particular golf club head configuration will tend to propel a golf ball with a lower and more controlled trajectory towards the center of the fairway.

As a further example, FIG. 15 shows elliptical shaped weight 138 located on bridge member 131 near the heel 21 of golf club head 134. In addition, elliptical shaped weight 138 is also rotated into a position below the point of engagement of a golf ball as indicated by its position, below bridge member 131 in FIG. 15. This placement of elliptical shaped weight 138 as shown in FIG. 15 will tend to lower and shift the center of gravity of golf club head 134 towards the heel 21 of golf club head 134. A golf ball hit with this particular golf club head configuration will tend to propel a golf ball with a higher trajectory towards the left of the fairway.

Elliptical shaped weight 138 may be replaced by alternate weights that have a different shape or a different mass to increase or decrease the degree to which the center of gravity of head 134 is repositioned. For example, various shapes such as rectangle, oval, triangle, trapezoid, square or other symmetrical or asymmetrical shapes may be utilized. Elliptical shaped weight 138 may also be made of various materials such as stainless steel, carbon steel, titanium, aluminum, tungsten, graphite, polymers, plastics or composites.

Golf club heads 14, 94, and 134 of the present invention may be incorporated into a set of iron golf clubs. For example, the present invention may be used with a plurality of increasing numbered iron golf clubs such as a two iron, a three iron, a four iron, a five iron, a six iron, a seven iron, an eight iron, a nine iron, and a pitching wedge. With the present invention, a golfer may modify the position of center of gravity for each golf club to meet their unique requirements or playing style.

Figure 16:
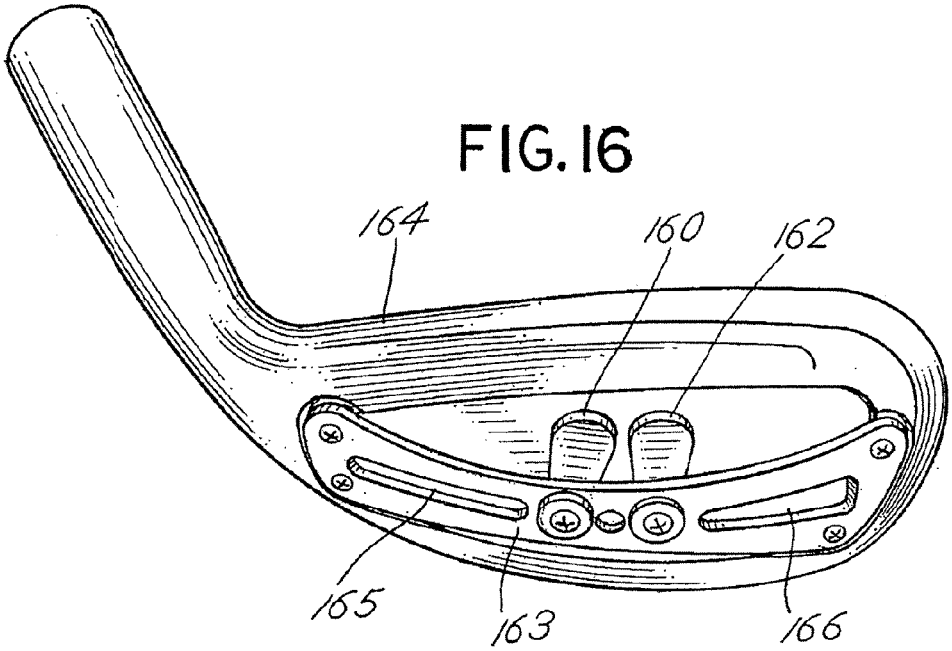
FIG. 16 illustrates a rear view of a golf club head with a plurality of weights attached to a bridge member in accordance with the present invention.
Figure 17:
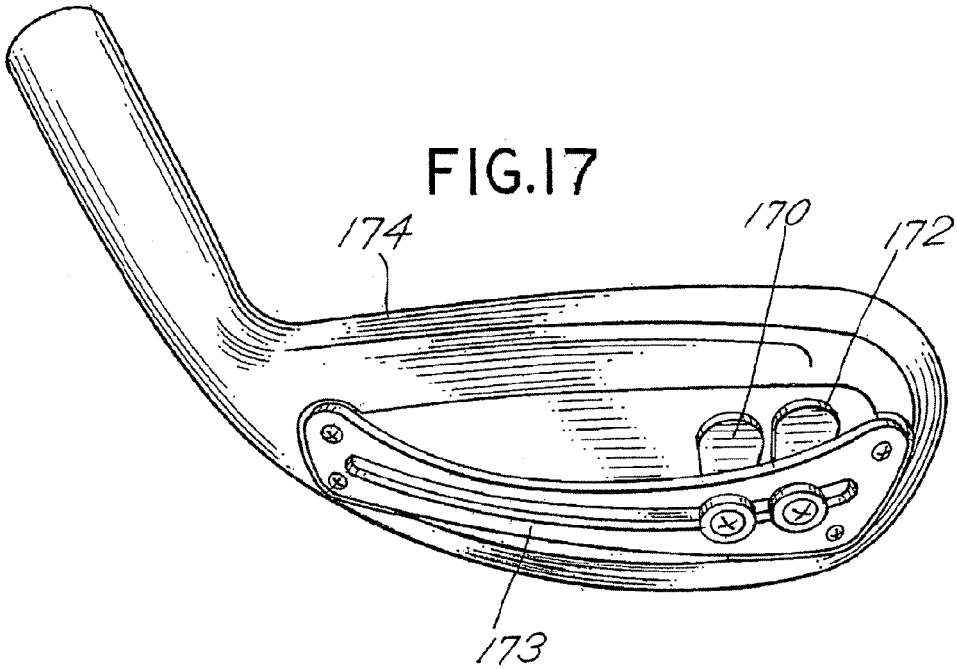
FIG. 17 illustrates an additional rear view of a golf club head with a plurality of weights attached to rail assembly integral to a bridge member in accordance with the present invention.

FIGS. 16 and 17 illustrate additional embodiments of the present invention in which a plurality of weights may be attached to a bridge member in a combination of configurations as previously described above to vary the position of the center of gravity of a golf club head 164. For example as shown in FIG. 16, a plurality of weights such as 160 and 162 may be attached to bridge member 163. Weights 160 and 162 may be positioned at fixed locations on bridge member 163. Alternatively, weights 160 and 162 may be moveably connected to rails 165 or 166 as illustrated in FIG. 16. Furthermore, weight 160 may be located at a fixed position on bridge member 163 and weight 162 may moveably connected to rail 165 or 166. Furthermore, as FIG. 17 illustrates, weights 170 and 172 may be both moveably connected to a rail 173 to add additional weight to back of the club head 174 to further vary the position of the center of gravity of golf club head 174.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. A golf club head comprising:

a heel;

a toe;

a body extending between the toe and the heel, the body comprising:

a striking face, the striking face having a contact area for engaging a golf ball;

a rear cavity, the rear cavity opposite the striking face;

a bridge member extending across the rear cavity, the bridge member having a front surface and a back surface;

a rail formed in the bridge member, the rail extending from the front surface through to the back surface; and a weight, the weight shaped to engage and slide along the rail to vary the position of the center of gravity of the golf club head with respect to the striking face.

2. The golf club head of claim 1, wherein the weight is movable to different locations along the rail formed in the bridge member.

3. The golf club head of claim 1, wherein the weight comprises a weight chip.

4. The golf club head of claim 1, wherein the weight is interchangeable with one of a plurality of alternate weights.

5. The golf club head of claim 4, wherein at least one of the alternate weights has a different mass than the weight.

6. The golf club head of claim 4, wherein at least one of the alternate weights has a different shape than the weight.

7. The golf club head of claim 1, wherein the weight further includes a locking mechanism to secure the weight to the rail at a fixed location along the rail.

8. The golf club head of claim 7, wherein the locking mechanism comprises a set screw.

9. A golf club head comprising:

a striking face that provides a contact area for engaging a golf ball;

a rear cavity opposite the striking face;

a bridge member extending across the rear cavity, the bridge member having a front surface and a back surface; and a weight positioning assembly integral to the bridge member, the weight positioning assembly including:

a rail, the rail extending from the front surface of the bridge member through to the back surface of the bridge member, and a weight movably connected to the rail to vary a position of a center of gravity of the golf club.

10. The golf club head of claim 9, wherein the weight is movable to different locations along the rail.

11. The golf club head of claim 9, wherein the weight comprises a weight chip.

12. The golf club head of claim 9, wherein the weight is interchangeable with one of a plurality of alternate weights.

13. A golf club head comprising:

a striking face that provides a contact area for engaging a golf ball;

a rear cavity opposite the striking face;

a bridge member extending across the rear cavity; and a weight positioning assembly integral to the bridge member, the weight positioning assembly including:

a rail, the rail extending from a front surface through to a back surface, and a weight movably connected to the rail, the weight being movable along the rail to vary a position of a center of gravity of the golf club head in a first direction with respect to the striking face, the weight being rotatable to further vary the position of the center of gravity of the golf club head in a second direction with respect to the striking face.

14. The golf club head of claim 13, wherein the weight comprises a weight chip.

15. The golf club head of claim 13, wherein the weight is interchangeable with one of a plurality of alternate weights.

16. The golf club head of claim 13, wherein at least one of the alternate weights has a different mass than the weight.

17. The golf club head of claim 13, wherein the weight is movable in three dimensions with respect to the striking face.

18. The golf club head of claim 13, wherein the weight is rotated and fixed in different positions along the rail to further vary the position of a center of gravity of the golf club head with respect to the face.

19. The golf club head of claim 13, wherein the weight further includes a locking mechanism to secure the weight to the rail at a fixed location along the rail.

20. The golf club head of claim 19, wherein the locking mechanism comprises a set screw.

* * * * *